US006668746B1

(12) United States Patent
Schia et al.

(10) Patent No.: US 6,668,746 B1
(45) Date of Patent: Dec. 30, 2003

(54) LIFTING VESSEL AND METHOD FOR POSITIONING, LIFTING AND HANDLING A PLATFORM DECK AND A JACKET

(75) Inventors: John Schia, Snaruya (NO); Tor Ole Olsen, Lysakor (NO); Kolbjorn Hoyland, Rykkin (NO); Kare O. Haereid, Olso (NO); Jorn Bastholm Hansen, Asker (NO); Trond Landbo, Haslum (NO)

(73) Assignee: MPU Enterprise AS, Lysaker (NO)

( * ) Notice: Subject to any disclaimer, the term of this patent is extended or adjusted under 35 U.S.C. 154(b) by 0 days.

(21) Appl. No.: 10/009,098

(22) PCT Filed: Jun. 7, 2000

(86) PCT No.: PCT/NO00/00197

§ 371 (c)(1),
(2), (4) Date: Jun. 7, 2002

(87) PCT Pub. No.: WO00/78604

PCT Pub. Date: Dec. 28, 2000

(51) Int. Cl.[7] ..... B63B 35/44
(52) U.S. Cl. ..... 114/264; 114/265
(58) Field of Search ..... 405/195.1, 196, 405/200, 203, 205; 114/264, 265

(56) References Cited

U.S. PATENT DOCUMENTS

| | | | | |
|---|---|---|---|---|
| 3,078,680 A | | 2/1963 | Wepsala | 61/46.5 |
| 3,386,404 A | | 6/1968 | Motora | 114/56 |
| 4,372,240 A | | 2/1983 | Michael | 114/56 |
| 4,474,509 A | * | 10/1984 | Antes et al. | 405/195 |
| 4,556,004 A | | 12/1985 | Lamy et al. | 114/61 |
| 4,714,382 A | | 12/1987 | Khachaturian | 405/204 |
| 4,848,970 A | * | 7/1989 | Hunter et al. | 405/224 |
| 4,927,296 A | | 5/1990 | Kaldenbach | 405/206 |
| 5,097,786 A | | 3/1992 | Sheffield | 114/258 |
| 5,829,919 A | | 11/1998 | Heerema | 405/209 |
| 6,196,767 B1 | * | 3/2001 | Thomas | 405/203 |

FOREIGN PATENT DOCUMENTS

| | | |
|---|---|---|
| GB | 2165188 | 4/1986 |
| NO | 942163 | 6/1994 |
| NO | 306385 | 11/1999 |
| WO | 9533892 | 12/1995 |

OTHER PUBLICATIONS

English translation of the Abstract of NO 942163 dated Jun. 10, 1994.

English translation of the Abstract of NO 306385 dated Nov. 1, 1999.

* cited by examiner

*Primary Examiner*—Stephen Avila
(74) *Attorney, Agent, or Firm*—Ladas & Parry

(57) ABSTRACT

A lifting vessel (1) consisting of a lower U-shaped pontoon foundation (2*a,* 2*b,* 2*c*), a number of vertical columns (5) attached to the pontoon foundation and extending upwards and through the water surface, and each column (5) being free-standing above the pontoon foundation (2*a,* 2*b,* 2*c*). Methods for positioning, lifting and handling of a platform dock and a platform jacket is also described.

14 Claims, 13 Drawing Sheets

Figure 1A:
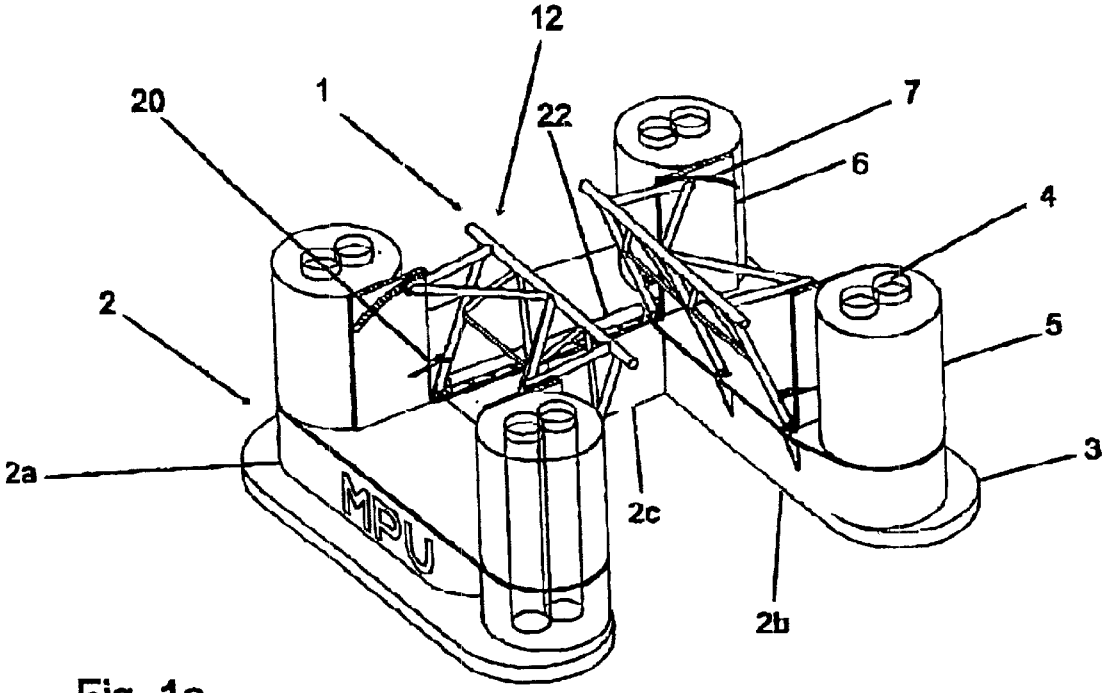

LIFTING VESSEL AND METHOD FOR POSITIONING, LIFTING AND HANDLING A PLATFORM DECK AND A JACKET

The present invention is related to a lifting vessel having a U-shaped pontoon, with two longitudinal and one transversal pontoon, and columns connected to the pontoon extending upwards and through the water surface.

The present lifting vessel is designed with a hull where the buoyancy can be adjusted by ballasting/deballasting, for lifting and transportation operations at sea.

The invention includes also methods for positioning, lifting and handling a platform deck and a jacket, with the help of the lifting vessel of the present invention.

In connection with offshore activities such as gas and oil exploitation it is usual to install platforms on the field. These platforms often consist of large and heavy platform substructures fixed to the seabed. Such a platform substructure is normally a so-called "jacket", which is a steel truss structure. On top of for example a jacket it is usual to place a platform deck, which is used in connection with drilling and production. The deck also often includes living quarters.

To transport and install the jacket and the platform deck described above, for example barges have been used to transport the jacket and platform deck out to the field, and large crane vessels have been used to install the platform on the field.

Heavy lift vessels using ballast to vary their draft have also been used to transport and install platforms offshore.

There are today a great number of offshore platforms installed to exploit oil and gas. When the oil and/or gas reservoirs are fully exploited the life span of the platform is usually over and it would in most cases be appropriate to remove the platform.

Some platforms are already removed, and removal of platforms will continue at an increasing pace the coming years.

The traditional way of removing platforms is to use large ocean going lifting cranes. The platform needs to be very thoroughly prepared prior to removal, and it must be cut into smaller parts since even the largest lifting crane vessels have limited lifting capacity. The same goes for the platform substructure (the jacket).

These operations are time consuming and costly, not only because the lifting cranes are large, expensive and need a large crew, but also because cutting a platform to smaller pieces in open sea is a very complicated task. It is also a risky operation.

The new technology, as described in this application, can be described as "single lift technology", and will reduce the costs considerably. It will also make the operations less risky than present alternatives. Within the category "single lift technology" there are three other concepts that the applicant is aware of at the moment:

"Offshore Shuttle" is a vessel planned built as a frame work structure. The vessel has a significant length and the lifting of for example a platform deck is based on cross-beams spanning across the structure.

"Master Marine" is developing a U-shaped semi submersible with deck-structure connecting the top of columns. Lifting is based on load transfer to the deck-structure.

"Versatruss" is a concept involving two separate barges each supporting its own lifting frame. By pulling the barges together after positioning the lifting frames beneath the lifting points on the platform deck, the lifting of the deck can be performed. This method has already been used to remove small platform decks in calm waters.

One object of the present invention is to accomplish a removal operation of a platform in a fast and cost effective manner without cutting either the deck or the jacket into smaller parts. The removal operation shall be performed in a safe way where the safety of the operators is accomplished in the best possible way.

Another object of the present invention is that the lifting vessel is as flexible as possible and that it can be easily adjusted to fit different sized platform decks. Further the lifting vessel shall be able to lift and handle jackets of different sizes. In accordance with the invention the lifting vessel, a so-called Multi Purpose Unit, MPU, which also can transport e.g. the platform deck to shore, and then transfer the deck to a barge or a pier suitable to the vessel.

Another object is that the lifting vessel shall be able to be transported on a heavy lift vessel, to reduce the travel time to distant destinations like the Gulf of Mexico and the Persian Gulf.

Another object of the lifting vessel is that it shall also be able to install platforms, which basically is the reverse of removal. The lifting vessel should furthermore be applicable to a range of purposes where a large lifting capacity is required.

The objects described above is achieved according to the invention by lifting vessel with a U-shaped pontoon, a number of columns connected to the pontoon and extending upwards towards and through the water surface, characterised by the columns not being structurally connected above the pontoon.

Preferred embodiments of the lifting vessel is further described in the claims 2 to 12.

The objects of the invention is further achieved by methods of positioning, lifting and handling of a platform deck and a jacket according to claims 13 and 14.

Figure 1B:
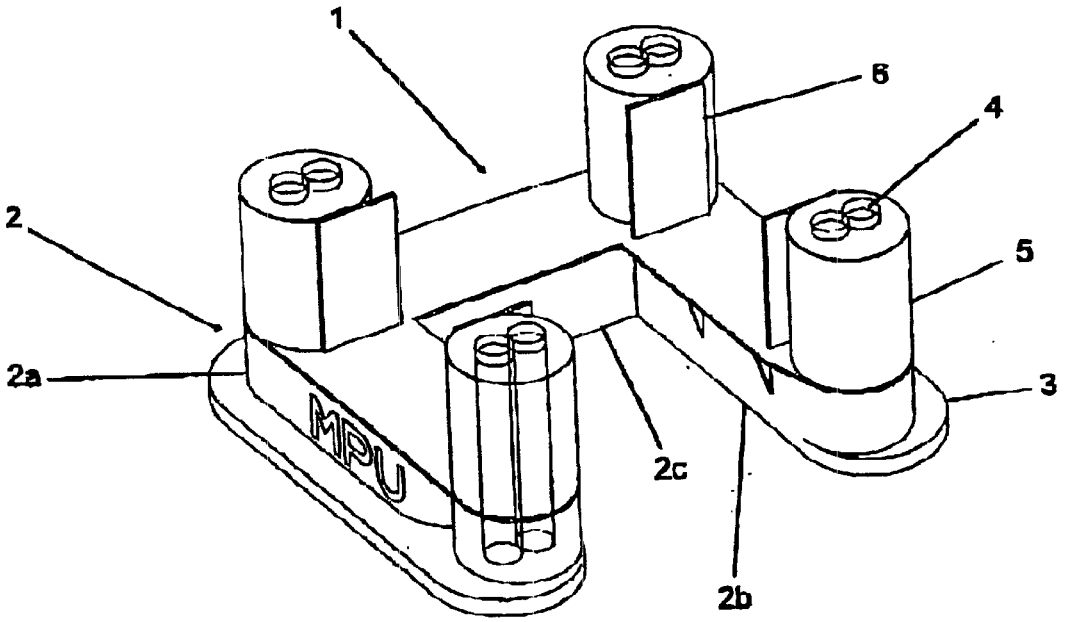
Figure 2:
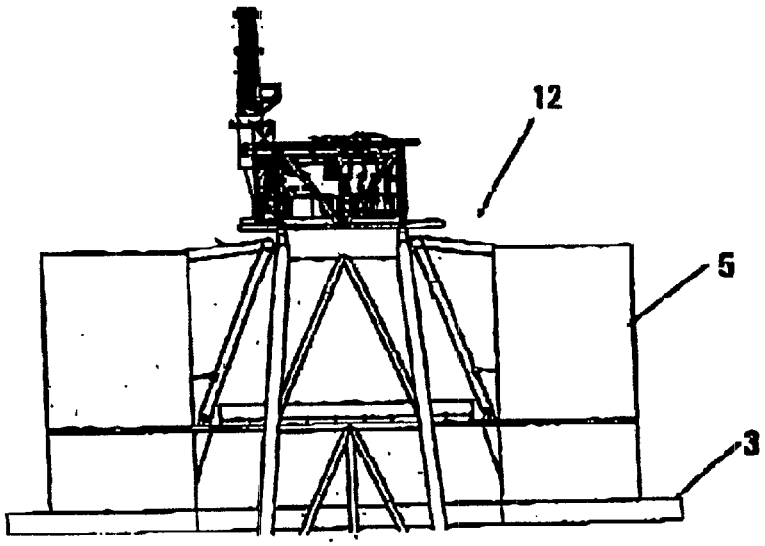
Figure 3:
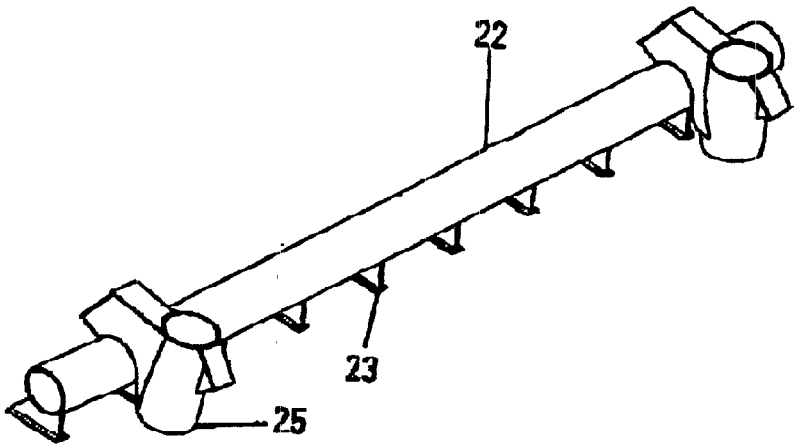
Figure 4:
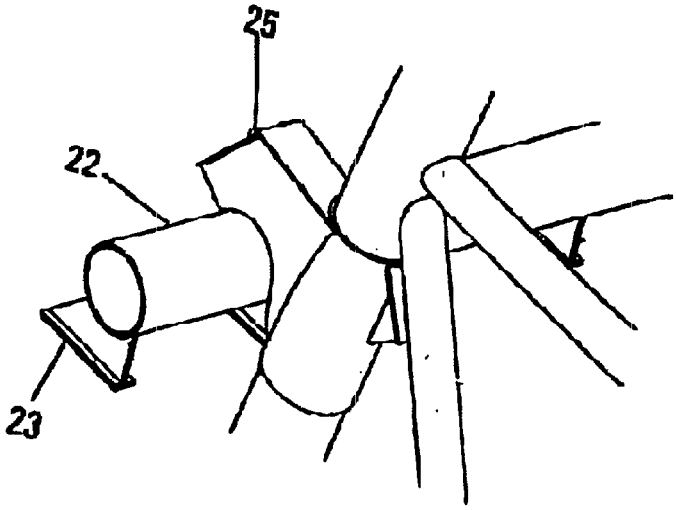
Figure 5A:
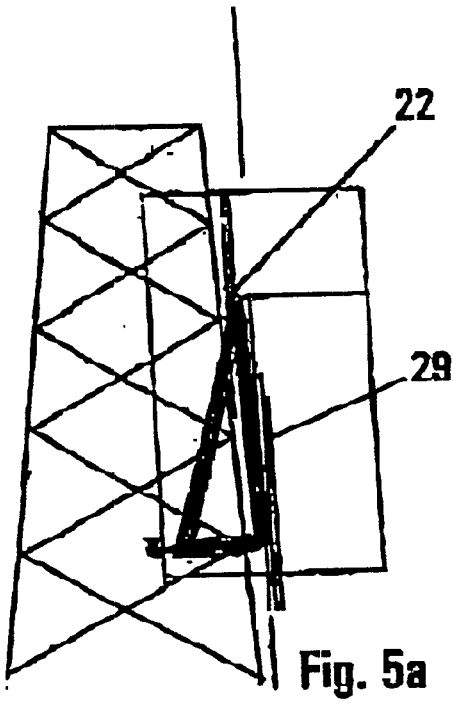
Figure 5B:
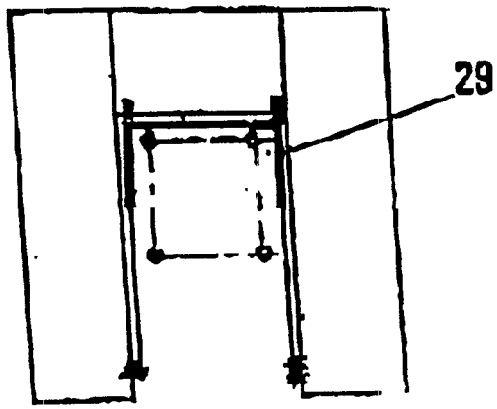
Figure 5C:
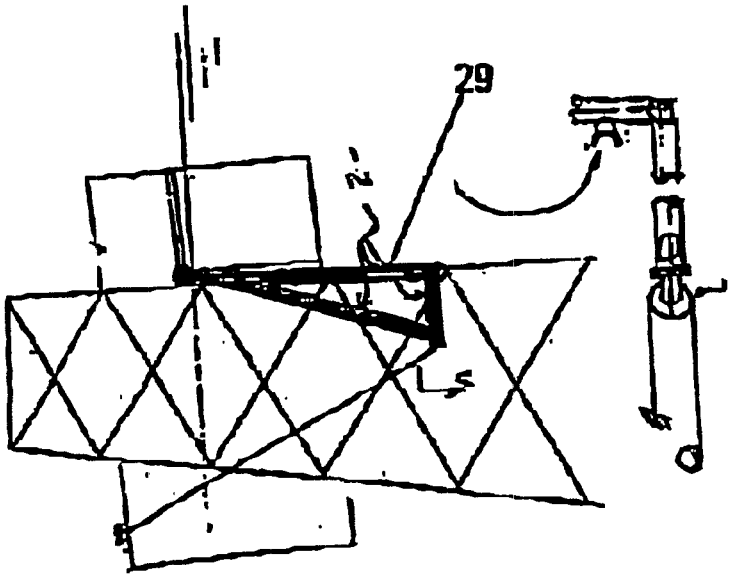
Figure 6:
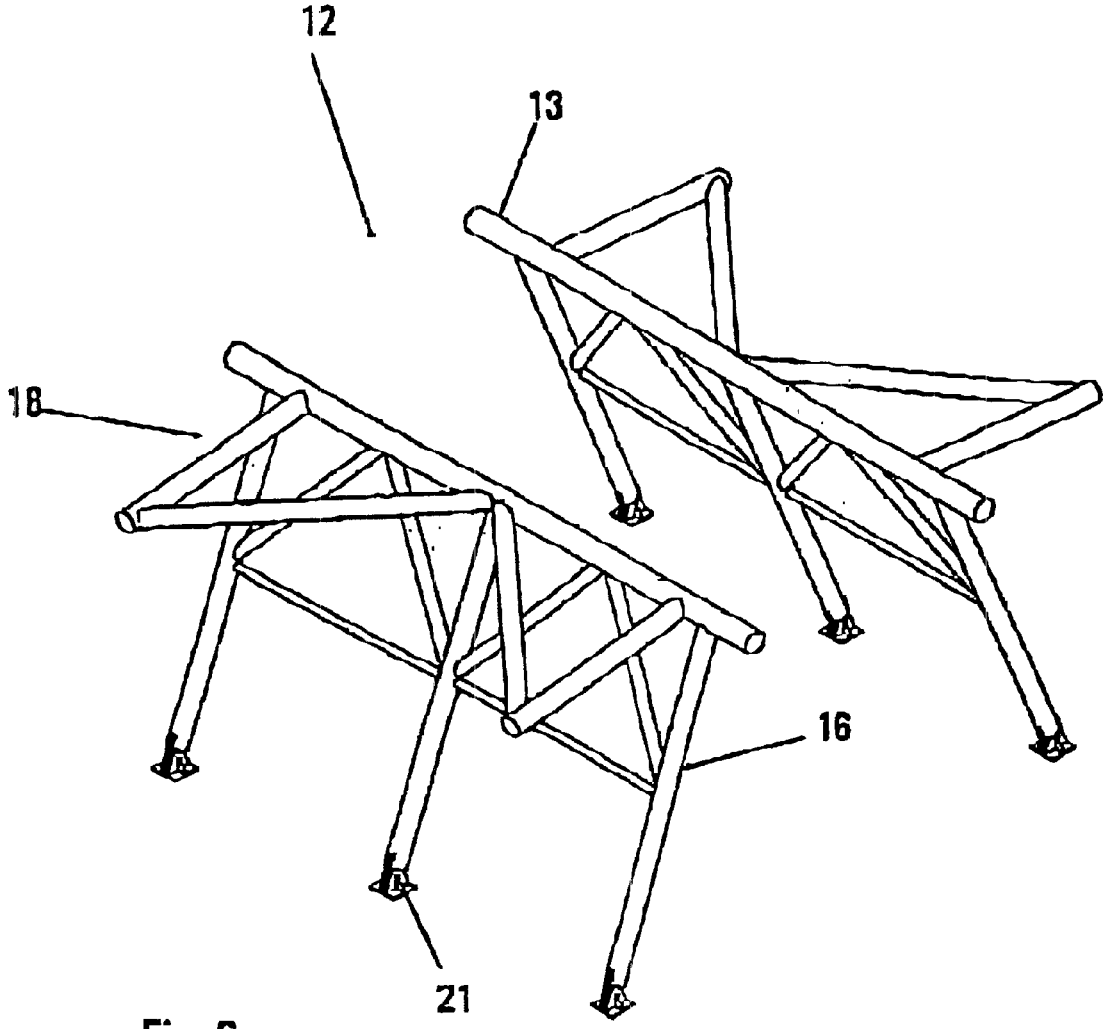
Figure 7:
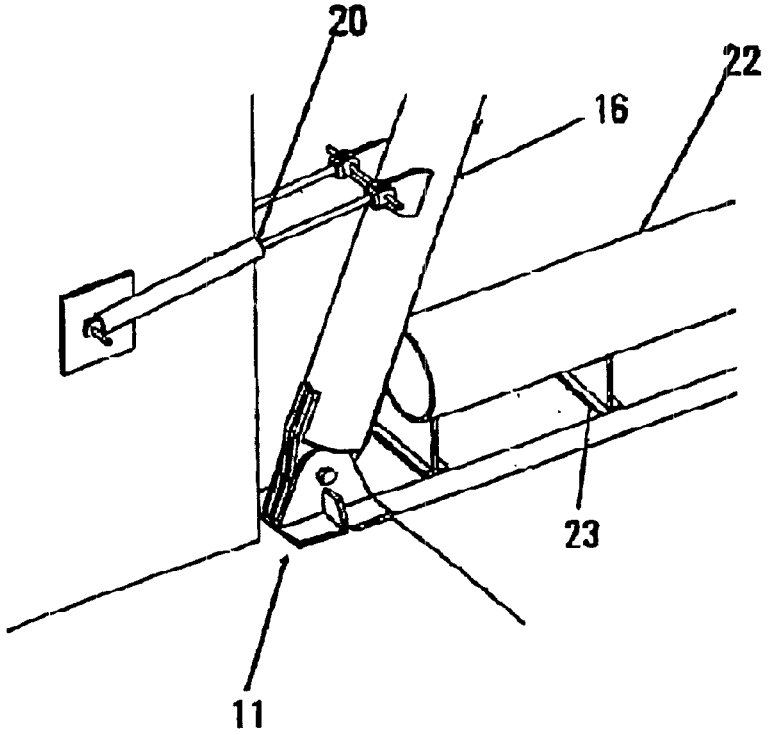
Figure 8:
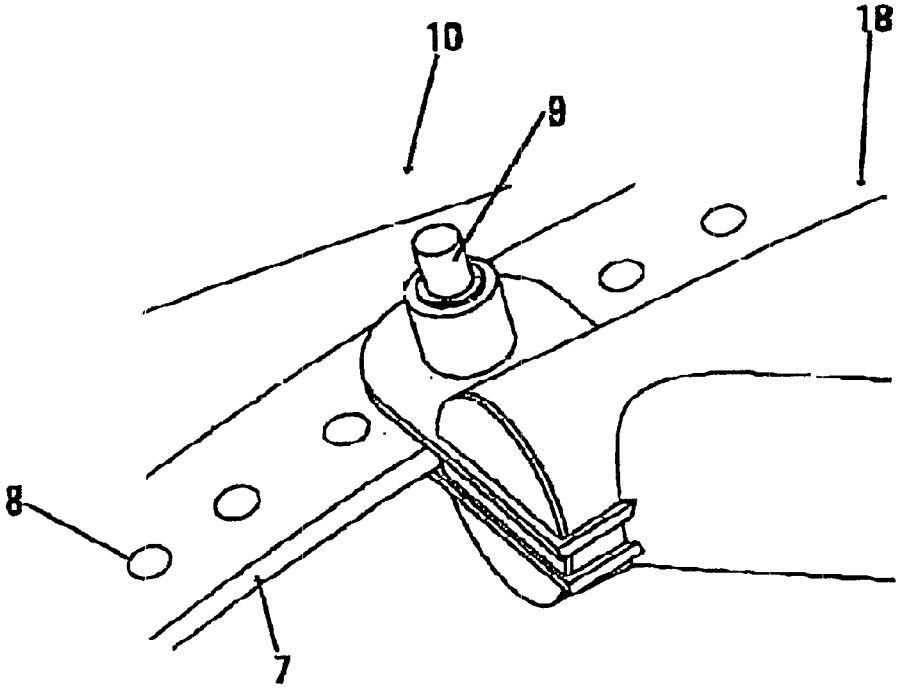
Figure 9:
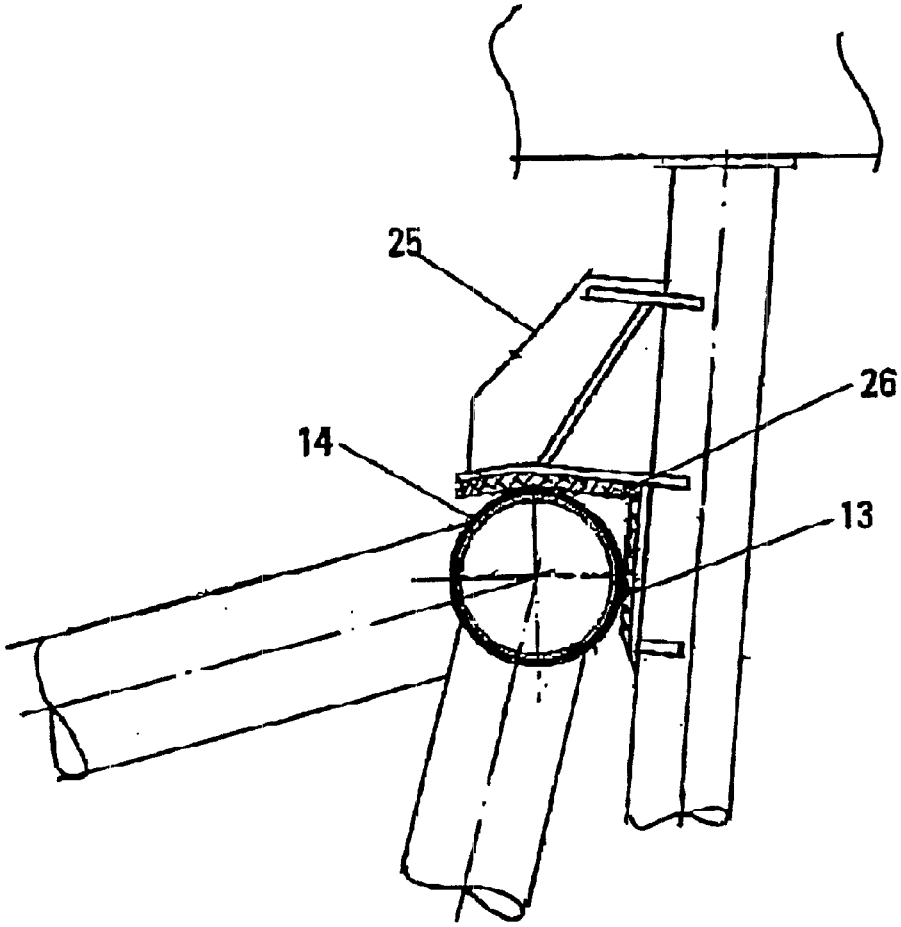
Figure 10A:
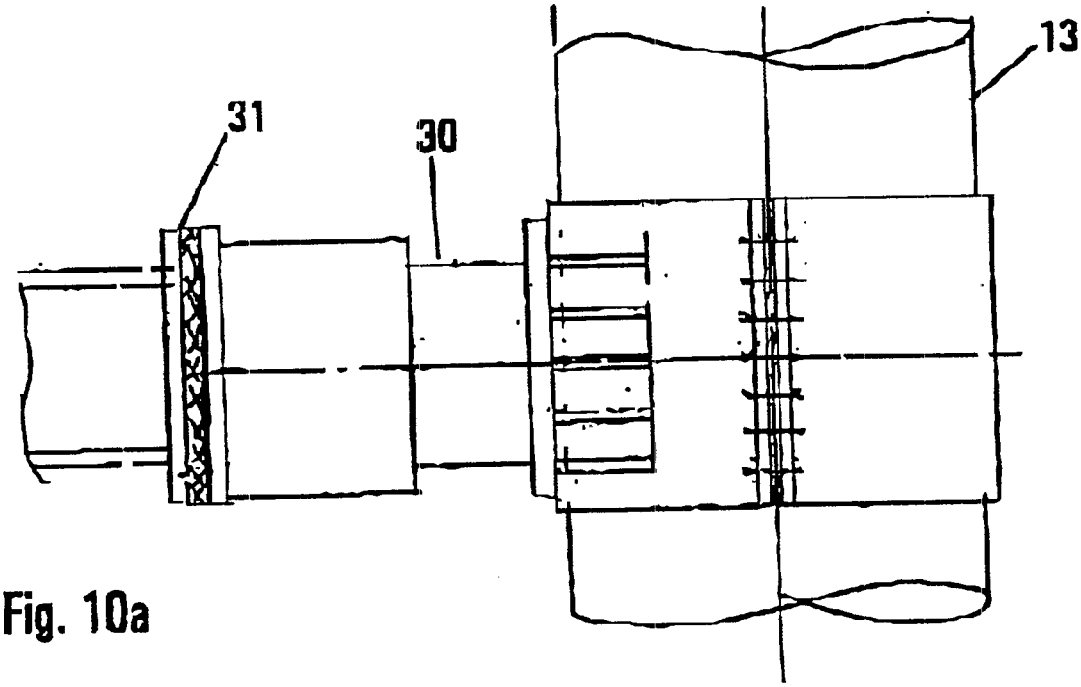
Figure 10B:
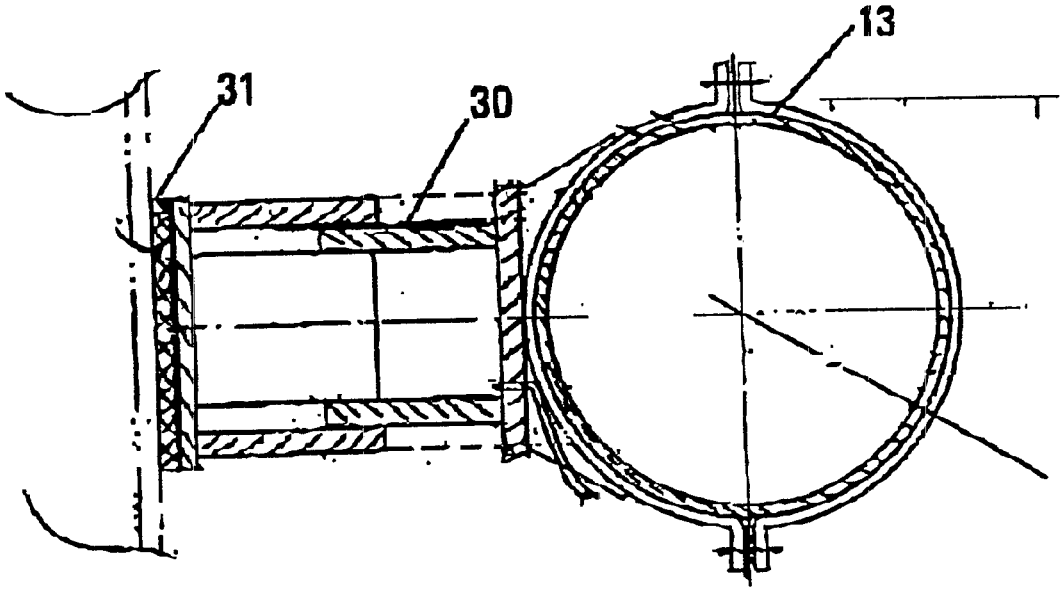
Figure 11A:
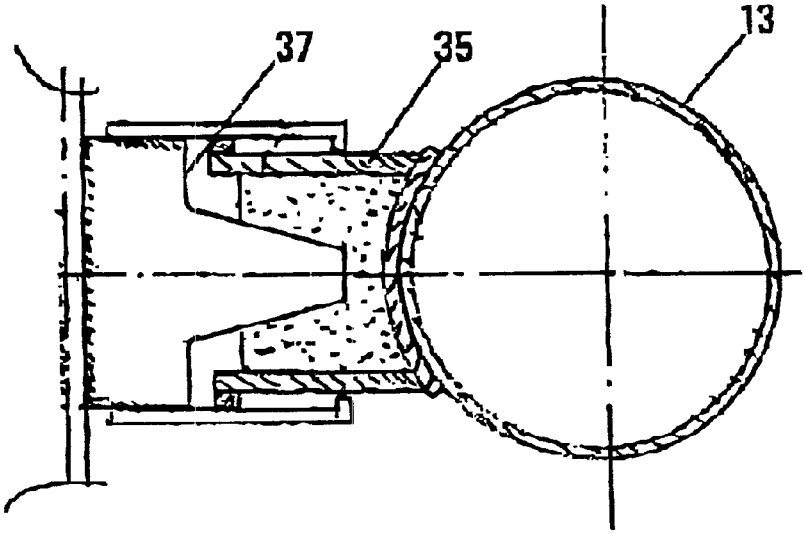
Figure 11B:
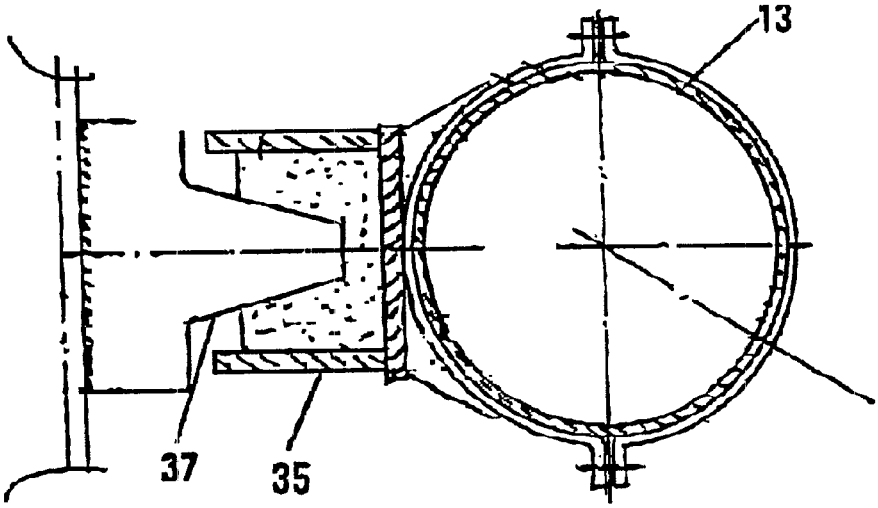
Figure 12:
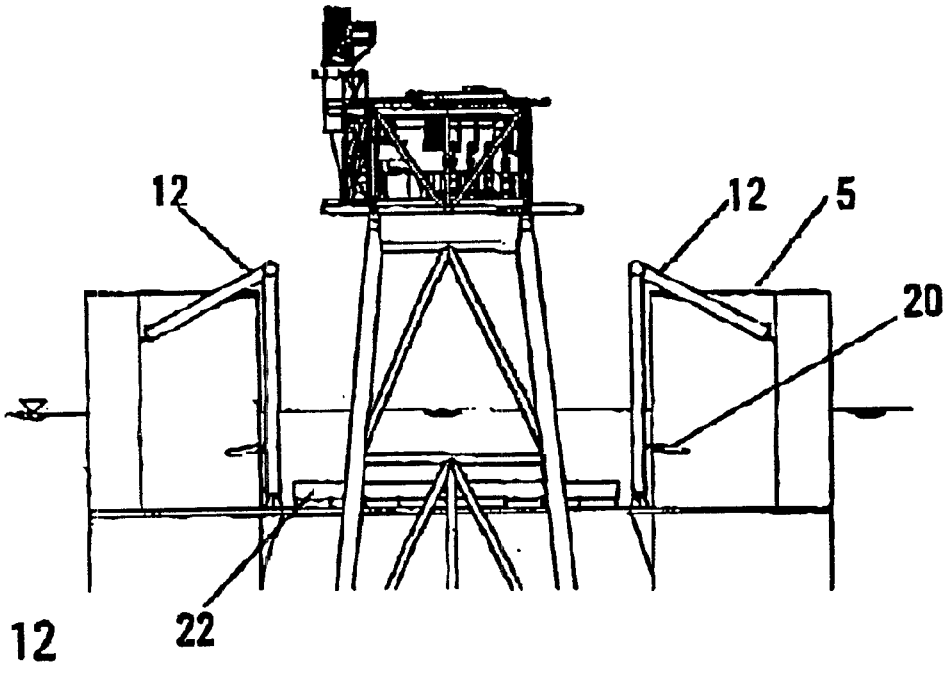
Figure 13:
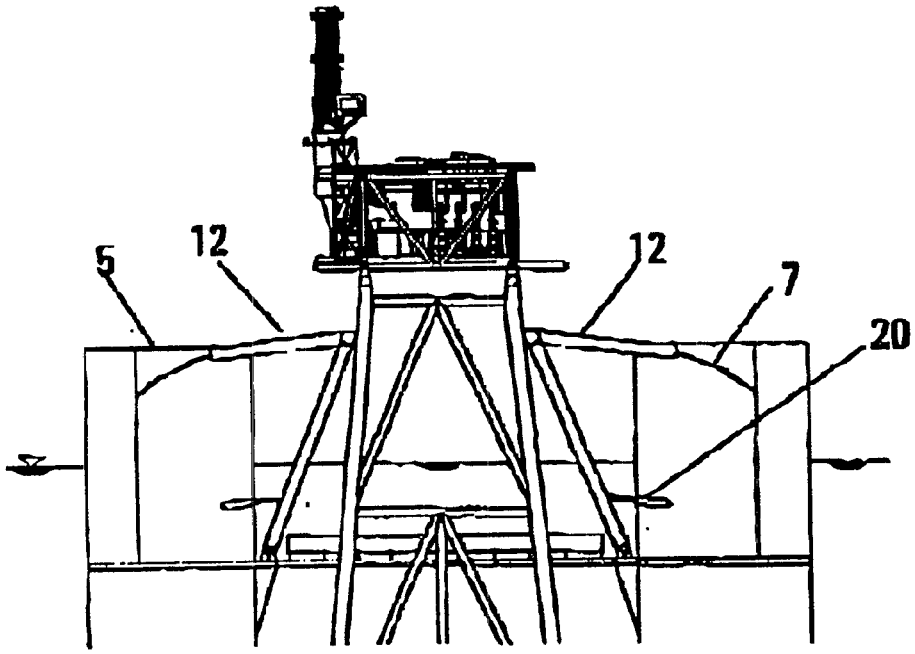
Figure 14:
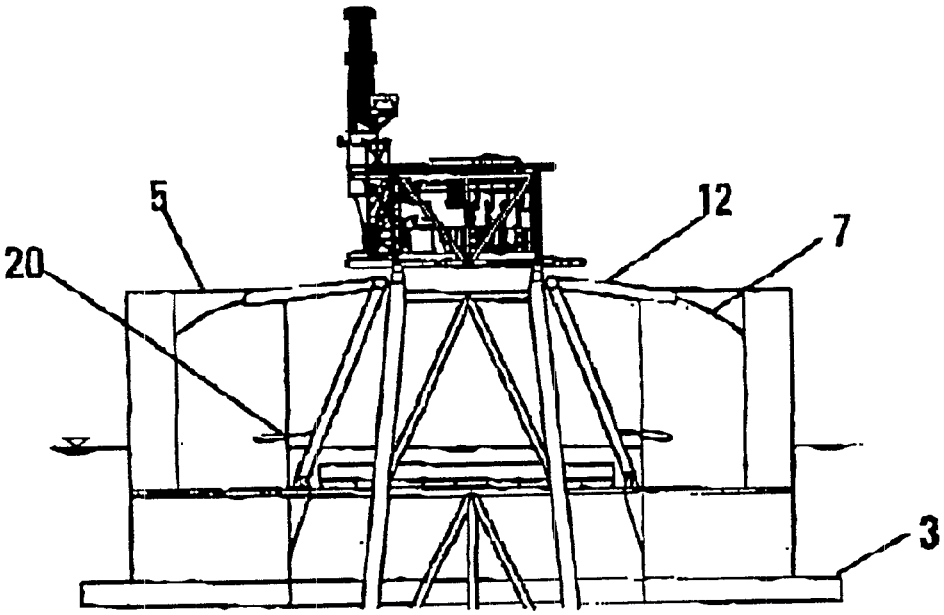
Figure 15:
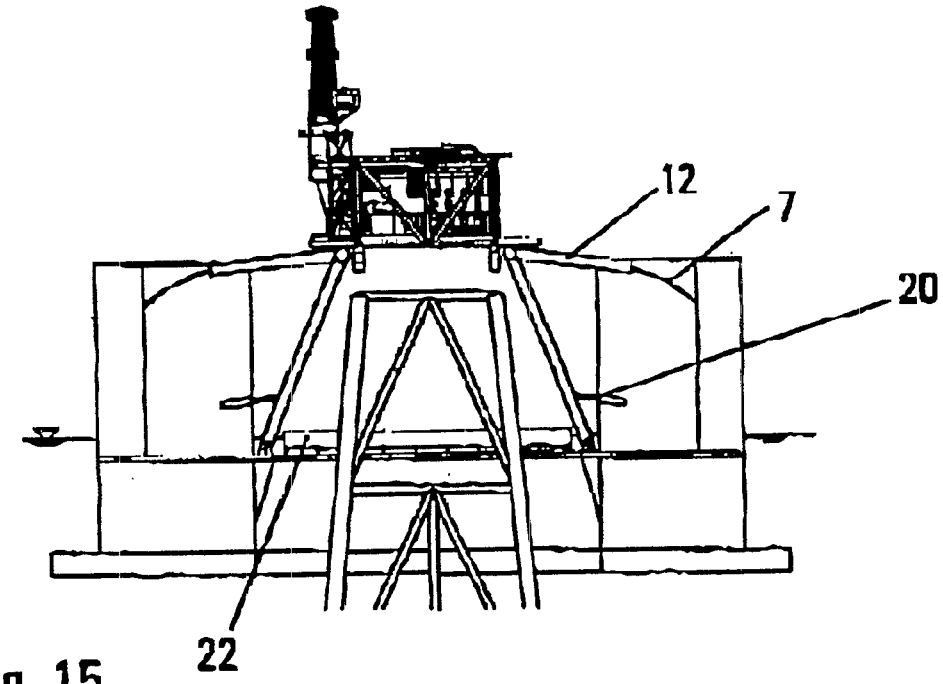
Figure 16:
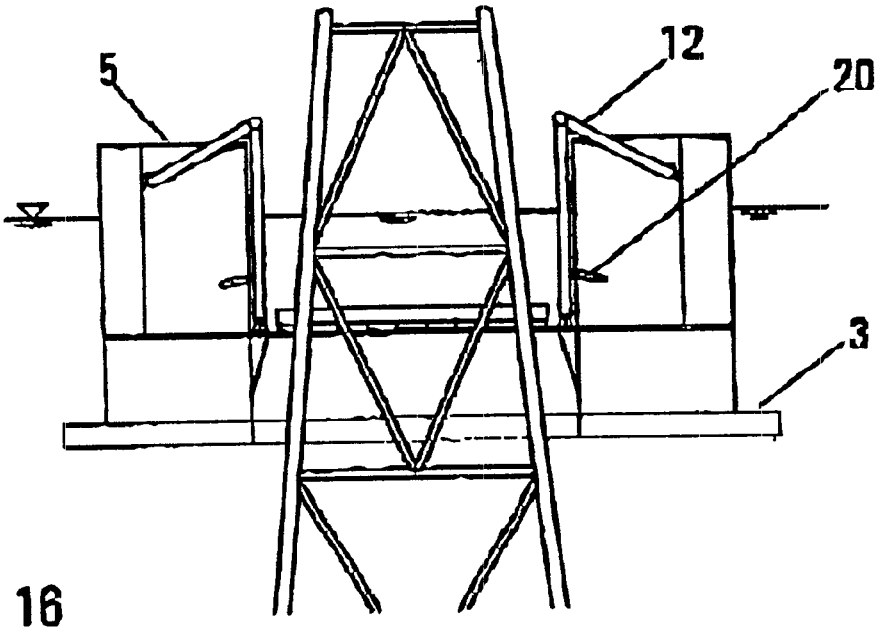
Figure 17:
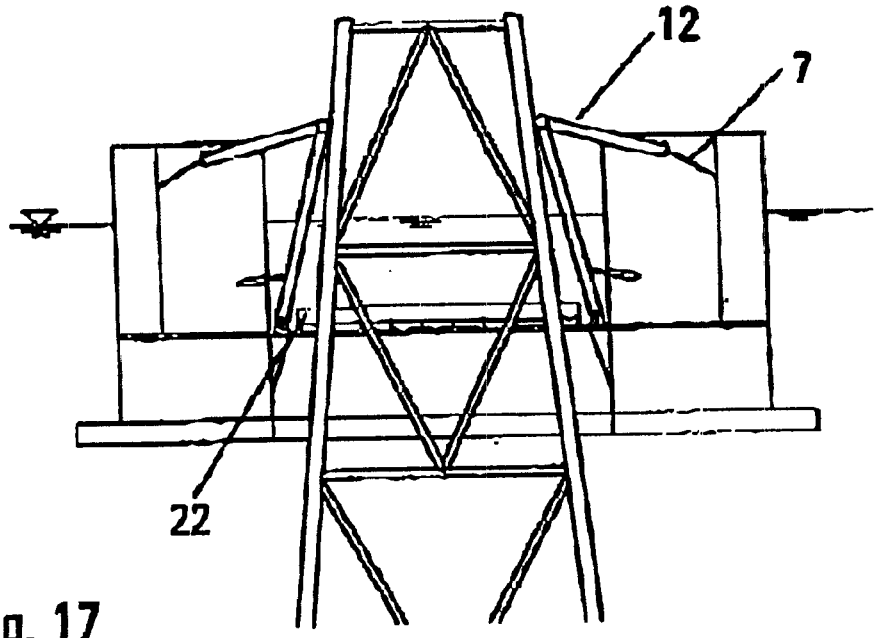

The present invention is described below with the help of examples of use and with references to the figures, where:

FIG. 1*a* shows a lifting vessel with attached lifting gear according to the present invention, FIG. 1*b* shows the lifting vessel according to the present invention, FIG. 2 shows the lifting vessel positioned around a jacket with a platform deck, FIG. 3 shows a steel tubular rotation beam for lifting and rotating a jacket structure, FIG. 4 shows a device for lifting and rotating a jacket structure for installation or removal, FIGS. 5*a*–5*c* show the vessel in connection with lifting and rotating a jacket structure where a special "cradle" is used, FIG. 6 shows lifting frames for lifting of preferably a platform deck, FIG. 7 shows hydraulic jacks for operating the lifting frame, situated between the lifting vessel and the inclined legs of the lifting frame and the figure also shows the steel tubular beam for lifting and rotation/removal of a jacket structure, FIG. 8 shows a hydraulic lock bolt system for locking of the lifting frame in a certain position to a guide rail connected to the lifting vessel, FIG. 9 shows one first alternative for a connection between the lifting frame and the jacket structure for removal of a platform deck, FIGS. 10*a* and 10*b* show a second alternative for a connection between the lifting frame and the jacket structure for removal of a platform deck, FIGS. 11*a* and 11*b* show a third alternative for a connection between the lifting frame and the jacket structure for removal of a platform deck, FIGS. 12, 13, 14 and 15 show step by step the operation sequence for removal of a platform deck with the help of the lifting vessel of the present invention, and FIGS. 16, 17, 18, 19 and 20 show step by step the operation sequence for removal of a jacket structure with the help of the lifting vessel of the present invention.

The lifting vessel according to the present invention will now be described with reference to the figures, especially FIGS. 1*a* and 2.

The lifting vessel 1 (MPU) is, according to the present invention, developed as a floating concrete hull with a U-shaped pontoon foundation 2 containing two longitudinal pontoons 2*a,* 2*b* and a transverse pontoon 2*c,* and with columns 5 through the water surface for hydrostatic stability and optimal behaviour in the sea. The columns 5 are not connected structurally at the top, which is made possible by a rigid and robust hull structure. A brim 3 along the lower edge of the pontoon foundation improves further the behaviour of the vessel in the sea. The vessel 1 is specially developed for operations offshore. The U-shape of the pontoon foundation 2*a,* 2*b,* 2*c* enables the vessel to position itself around a platform being installed or a platform being removed, be it the platform deck or a platform substructure. The lifting operation is performed according to Archimedes' principle by ballasting/deballasting the vessel 1. The lifting is mainly performed vertically, but the vessel 1 can be inclined in all directions to enable special lifting operations.

Positioning of the vessel 1 is considered done by tugs, but thrusters can be installed to make the vessel 1 self-propulsive. The vessel 1 is designed to operate in all oceans in all parts of the world. The vessel 1 is also designed to be transported on a heavy lift ship to ease transportation over large distances.

The vessel 1 is equipped with devices specially fitted for the operations the vessel 1 is intended for. Installation and removal of platforms (platform decks and platform substructures) for the oil and gas industry are examples of operations the vessel 1 is intended for.

Installation and removal of platform substructures are mentioned above as fields of operation for the lifting vessel 1 of the present invention. The vessel 1 will now be described in relation to these operations, especially in connection with the handling of jackets. Steel jackets are widely used all over the world in the oil and gas industry as substructure for offshore oil and gas production units. There are also many other situations where a jacket structure is suitable as a support structure. There will be a market for both installation and removal of jackets in the future. Below is described operations concerning removal of a jacket. For installation the operations will be performed in the reverse order.

Lifting brackets 25 are attached to the jacket legs on one side of the jacket at a certain, pre-established height. A circular tubular rotation beam 22 is fixed to the top of the transverse pontoon 2*c* of the lifting vessel 1. The lifting vessel 1 is positioned around the jacket with the help of tugs and active use of a lifting frame 12. This lifting frame will be described more thoroughly later in connection with lifting devices for positioning and lifting of a platform deck. The vessel 1 is hauled to a position where the transverse pontoon 2*c* of the vessel 1 is positioned close to the side of the jacket where the lifting brackets 25 are attached. The lifting vessel is ballasted to the desired draft and inclination of heel so that the tubular rotation beam 22 connects with the lifting brackets 25, see FIG. 4, concurrent with the lower edge of the transverse pontoon 2*c* bear against the jacket legs with fenders between them. The lifting brackets 25 are locked to the tubular rotation beam 22 and by deballasting the lifting vessel 1 the jacket is lifted. When the jacket is lifted clear of the seabed or foundation the lower part is lifted to the surface using wires and winches (or buoyancy modules), thereby rotating the jacket about the tubular rotation beam 22, before transportation to a new destination.

The lifting brackets 25 are made of steel of robust design and will absorb all forces introduced by the lifting and rotating operations. The lifting brackets 25 are designed to lock onto the tubular rotation beam. The lifting brackets 25 easily rotate on the tubular rotation beam 22.

Pre-engineering is required with regards to the strength of the jacket structure before a lift can take place. The jacket legs must be reinforced if they cannot endure the loads introduced. The lifting brackets 25 can be shaped with two long tubular clamps with a plate between them, so that they can be mounted to the main leg and a diagonal bracing of the jacket. The brackets 25 will then absorb the forces from the tubular rotation beam 22 and distribute them to the tubular clamps, which in turn distribute the forces onward in axial direction of the legs and the braces of the jacket, and so avoiding the largest shear forces. This device must be dimensioned for each individual case.

For some jackets it may be difficult to dimension the support for the brackets 25. If this is a problem a "lifting cradle" according to the invention can be used, see FIG. 5. The lifting cradle is attached to the tubular rotation beam 22 and uses this as a rotation point as described above. The cradle 29 is a framework consisting of two triangular frames pointing outwards with a pointed end upwards, attached to the tubular rotation beam 22 on the pontoon. The triangular frames are connected with a tubular beam at the bottom of the perpendicular. The cradle 29 consists of tubes 2–3 meters in diameter that are filled with water when the cradle 29 is in its lowest position and will be emptied when the lift starts. The large dimensions secure structural strength and enough buoyancy to contribute to the lift.

The lifting vessel 1 is positioned as described above and the cradle 29 will embrace the jacket. Specially adjusted saddles are attached to the lower circular beam on the cradle 29, resting against the jacket legs. To avoid the jacket from sliding off the cradle 29 during the lift the jacket is connected to the tubular rotation beam 22 through brackets attached to the jacket legs. On the back of the lifting vessel 1 winches are mounted on each side of the "docking area" i.e. the inner area of the U-shaped pontoon foundation surrounded by the two longitudinal pontoons 2*a,* 2*b* and the transversal pontoon 2*c*. Winches onboard tugs can also be used. Through pulleys wires with a hook in one end is hooked to the lower corners of the cradle 29. The cradle 29 is now lifted upwards rotating about the tubular rotation beam 22 and the jacket is lifted out of the water for safe transportation to shore. An alternative method is to ballast/deballast the vessel 1 combined with the use of buoyancy modules attached to the jacket.

Lifting devices for positioning and lifting of a platform deck will now be described with reference to the drawings. Platform decks exist in different sizes and to be able to handle them all, the lifting device must be large, strong and flexible/adjustable, with strict requirements to the shape for positioning around the substructure carrying the deck.

Lifting frame 12 is fitted with a horizontal robust lifting beam 13 at the top and is pin-connected 21 to the top of the longitudinal pontoons 2*a,* 2*b* on each side of the docking area, see FIG. 1. The lifting frame 12 consists of a near-horizontal structure 18, preferably a truss structure, going from the horizontal lifting beam 13 to the upper anchorage point 10 on the lifting vessel 1. Furthermore the lifting frame 12 consists of a vertical support structure 16, preferably a truss-work, connected in its upper end to the lifting beam 13 and connected in its lower end to the lifting vessel through an anchorage point 11, preferably a pin connection 21. The lifting frames 12, 12 in the upright position stands taller than the top of the lifting vessel 1, such that the lifting beams 13, 13 are always above the hull of the lifting vessel 1. The lifting frames 12, 12 can, with the use of the hydraulic cylinders 20, 20 connected to the lifting vessel 1 and the lifting frames 12, 12, see FIGS. 1*a* and 7, be inclined towards the middle of the docking area to position the lifting beams 13, 13 under the lifting points on the platform deck. The two lifting frames 12, 12 can be run independently. The lifting frames 12, 12 are locked in the right position before the lift starts, with hydraulic bolts 9 through holes 8 in guide rails 7 connected to each of the four columns 5 on the hull of the lifting vessel 1, see FIGS. 1 and 8. This ensures fixation in all directions included sea fastening during transport. Plane outer walls 6 tangentially fixed to the columns 5 are supporting the guide rails 7. The plane walls 6 are furthermore perpendicular to the direction of the connection line between two columns 5, 5.

The connection between the lifting beam 13 and the deck can be carried out in different ways. Below is described three ways that ensures adequate flexibility to absorb shocks during a lift off:

i) The lifting beam 13 can be equipped with a shock absorbing cover 14 while also placing shock absorbing cushions underneath the deck. If it is not possible to lift directly underneath the deck the upper part of the jacket can be fitted with brackets 26 with shock cushions so that the lifting beam 13 can get a proper hold, see FIG. 9. Prior to lift off the jacket will be cut right below the brackets 26.

ii) Hydraulic cylinders 30 are placed on top of the lifting beam 13 in well calculated positions to get direct contact with the lifting points on the deck structure (or brackets 26 on the upper part of the jacket). Shock absorbing cushions are placed between the deck structure and the hydraulic cylinders 30 to obtain maximum damping, see FIG. 10.

iii) "Shock cells" consisting of cylinders 35 filled with sand or another shock absorbing material is placed on top of the lifting beams 13 in well calculated positions. Conical tube stubs 37 are placed in corresponding positions on the deck structure. The conical tube stubs 37 absorb shocks when they penetrate the sand-filled cylinders 35, see FIG. 11*a*. An alternative is that both the tube stubs 37 and the shock cells 35 are mounted on the deck structure, see FIG. 11*b*.

The MPU 1 is positioned around a jacket structure with deck and is made ready for lift off and removal of the deck. The lifting frames 12, 12 on each side of the docking area is actively used for positioning by inclining them against the jacket with the help of hydraulically controlled arms 20, see FIG. 2. Additionally the positioning is done by tugs. The lifting frames 12, 12 are pulled back into lifting position when the MPU 1 is in the right position, as described above. The MPU 1 is then deballasted slowly until the lifting beams 13 are touching the lifting points. Compensation for the vertical motions of the MPU 1 is partly done by flexible shock cushions mounted on the lifting beams and lifting points, and partly by the use of a flushing system that ensures a quick load transfer. When the deck has a safe clearance to the jacket the MPU is pulled away from the jacket before ballasted down to transport draft.

The flushing system consists of flushing (ballast) tanks 4 above the waterline with large area quick release trapdoors that enable the water to flush out. Trapdoors on different levels enable multiphase flushing, i.e. flushing in several steps.

This example describes the operations for removal of a platform deck. The different operations are illustrated in a sequence of figures; FIGS. 12–15:

i) Positioning around a jacket with a deck.
With the help of tugs the MPU 1 is positioned around the jacket. The lifting frames 12, 12 are in upright position with good clearance to the jacket. The draft of the vessel 1 ensures good clearance to the deck, see FIG. 12.

ii) Using the lifting frames 12, 12 to fine adjust the position around the jacket.
When the MPU 1 is approaching the correct position the lifting frames 12, 12 are inclined against the jacket to dampen the horizontal motions of the MPU 1 and also to fine-adjust the position. This is done by active use of hydraulics, see FIG. 13.

iii) Deballasting the MPU 1, ready for lift-off.
The MPU 1 is deballasted while the lifting frames 12, 12 glide along the jacket structure to dampen the horizontal motions. The deballasting proceeds until the lifting frames 12, 12 are right under the lifting points on the deck. The lifting frames 12, 12 are then locked into position and MPU 1 is ready for lifting off the platform deck, see FIG. 14.

iv) Lift-off of the deck
When the MPU 1 is ready to lift off the deck, water in the flushing tanks 4 are let out quickly by opening the quick release trapdoors in the columns 5 thereby achieving a rapid lift. The deck is prepared in advance by cutting the connections between the deck and the jacket, see FIG. 15.

v) Ready for transportation to shore
After lift-off the MPU 1 is pulled away from the remaining jacket. The MPU 1 is deballasted down to transportation draft when it is clear from the jacket. If necessary additional sea fastening to the locking of the lifting frames 12, 12 are added and the transportation to shore can start. It is also possible to transfer the deck to a barge for transportation to shore so that the MPU 1 is immediately available for new operations (e.g. removal of the jacket).

Figure 18:
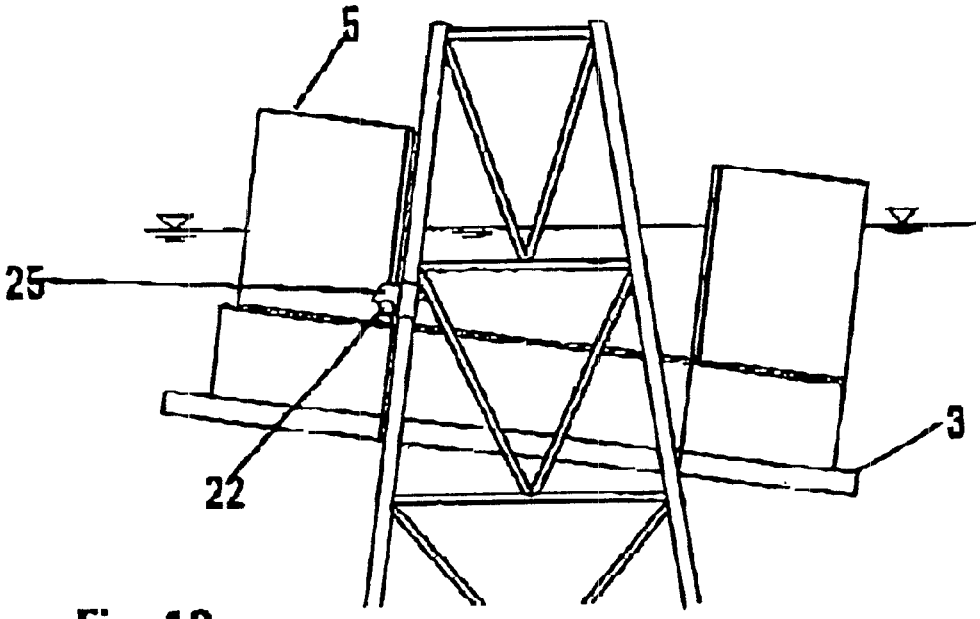
Figure 19:
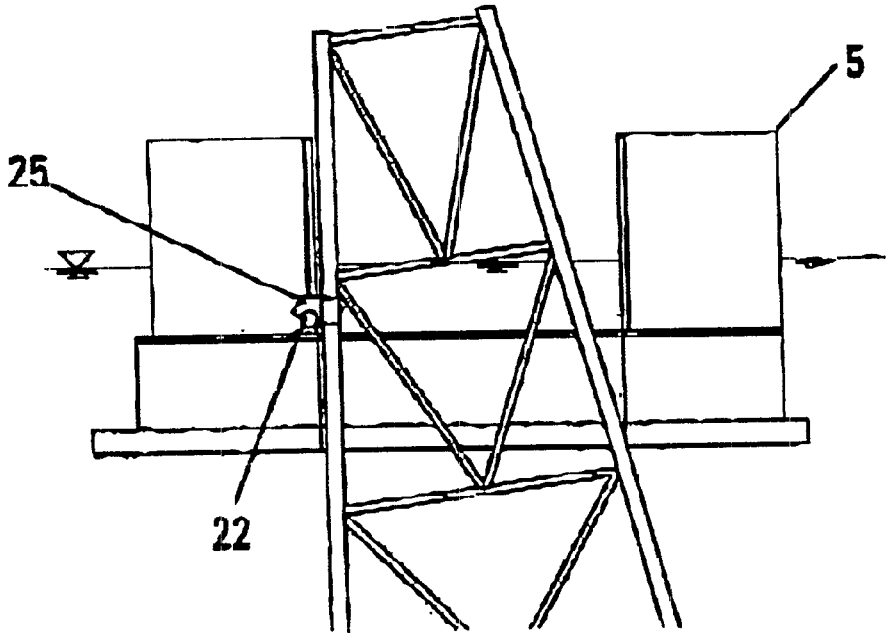

This example describes the operations for removal of a jacket structure. The different operations are illustrated in a sequence of figures; FIGS. 16–20:

vi) Positioning around a jacket (without a deck).
With help from tugs the MPU 1 is positioned around the jacket. The lifting frames 12, 12 are in upright position with good clearance to the jacket, see FIG. 16.

vii) Using the lifting frames 12, 12 to fine adjust the position around the jacket.
When the MPU 1 is approaching the correct position the lifting frames 12, 12 are inclined against the jacket to dampen the horizontal motions of the MPU 1 and also to fine-adjust the position. This is done by active use of hydraulics, see FIG. 17.

viii) The MPU is inclined and deballasted, ready for lift-off
The MPU 1 is inclined and deballasted until the tubular rotation beam 22, situated on top of the transversal pontoon 2*c*, gets a hold of the brackets 25 pre-installed on the jacket, see FIG. 18.

ix) Lift-off

When the MPU 1 is ready to lift off the jacket, water in the flushing tanks 4 are let out quickly by opening the quick release trapdoors in the columns 5 thereby achieving a rapid lift. The jacket is prepared in advance by cutting the jacket legs, piles, risers etc., see FIG. 19.

x) Tilting of the jacket, ready for transportation

Figure 20:
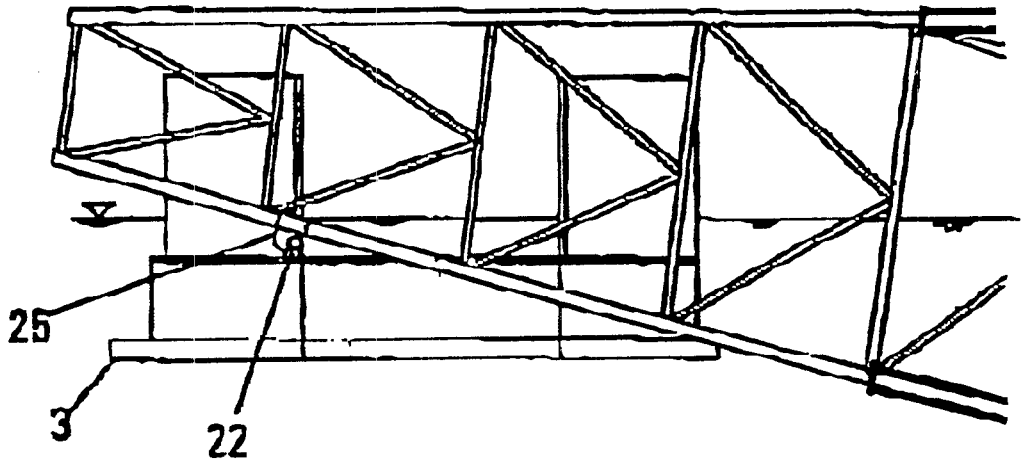

After lift-off, the jacket is rotated to a near-horizontal position with the use of winches and wires mounted on the aft of the MPU 1 or winches and wires onboard tugs, see FIG. 20. An alternative method is to attach buoyancy modules to the jacket. After sea fastening the transportation to shore can start. An alternative is to transfer the jacket to a barge for transportation to shore so that the MPU 1 is immediately available for new operations.

What is claimed is:

1. A lifting vessel (1) for positioning, lifting and handling a marine structure by establishing a connection between the lifting vessel (1) and the marine structure, the lifting vessel (1) comprising a lower U-shaped pontoon foundation (2*a*, 2*b*, 2*c*), and columns (5) attached to the pontoon foundation (2*a*, 2*b*, 2*c*) for extending upwards towards and through a water surface, characterised by each of the columns being free-standing above the pontoon foundation (2*a*, 2*b*, 2*c*) and a number of the columns (5) being equipped with an external plane wall (6), tangentially arranged on the number of the columns.

2. A lifting vessel (1) according to claim 1, characterised by the number of columns (5) being four.

3. A lifting vessel (1) according to claim 1, characterised by the pontoon foundation (2*a*, 2*b*, 2*c*) being equipped in file lower area with a horizontal brim (3) attached to at least pats of the periphery of the pontoon.

4. A lifting vessel (1) according to claim 2, wherein the tubular rotation beam (22) is mounted on top of a transversal pontoon (2*c*) of the pontoon foundation.

5. A lifting vessel (1) according to claim 1, characterised by the plane wall (6) being arranged perpendicular to a connection line between two of the columns (5).

6. A lifting vessel (1) according to claim 1, characterised by the plane walls (6) being equipped with upper and lower anchorage points (10, 11) for lifting devices in respectively the top and bottom area of the plane walls (6).

7. A lifting vessel (1) for positioning, lifting and handling a marine structure by establishing a connection between the lifting vessel (1) and the marine structure, the lifting vessel (1) comprising a lower U-shaped pontoon foundation (2*a*, 2*b*, 2*c*), and columns (5) attached to the pontoon foundation (2*a*, 2*b*, 2*c*) for extending upwards towards and through a water surface, characterised by each of the columns being free-standing above the pontoon foundation (2*a*, 2*b*, 2*c*) and the columns (5) being equipped with upper and lower anchorage points (10, 11) for lifting devices in respectively the top and bottom area of the columns (5).

8. A lifting vessel (1) according to claim 7, characterised by the upper anchorage points (10) consisting of guide rails (7) with holes (8) and locking bolts (9).

9. A lifting vessel (1) according to claim 7, characterised by the lower anchorage points (11) being articulated.

10. A lifting vessel (1) according to claim 7, characterised by at least two adjustable lifting frames (12, 12), each able to incline towards the middle of the docking area, consisting of a horizontal upper lifting beam (13) situated on a level above the top of the lifting vessel (1), a framework (16) attached to the lifting beam (13) in the upper end and in the lower end hinged (21) to the lifting vessel (1) and an approximately horizontal structure (18) which in one end is connected to the lifting beam (13) and in the other end adjustably connected to the columns, i.e. through the guide the support frames (16).

11. A lifting vessel (1) according to claim 10, characterised by hydraulic arms (20), spanning between the lifting vessel (1) and the support fame (16), mounted in an area above the articulated anchorage points (11).

12. A lifting vessel (1) for positioning, lifting and handling a marine structure by establishing a connection between the lifting vessel (1) and the marine structure, the lifting vessel (1) comprising a lower U-shaped pontoon foundation (2*a*, 2*b*, 2*c*), and columns (5) attached to the pontoon foundation (2*a*, 2*b*, 2*c*) for extending upwards towards and through a water surface, characterised by each of the columns being free-standing above the pontoon foundation (2*a*, 2*b*, 2*c*) and a tubular rotation beam (22) mounted on top of the pontoon foundation (2*a*, 2*b*, 2*c*).

13. A method for positioning, lifting and handling a platform deck with the use of a ballastable lifting vessel (1) by establishing a connection between the lifting vessel (1) and the platform deck wherein the lifting vessel (1) comprising a lower U-shaped pontoon foundation (2*a*, 2*b*, 2*c*), and a number of vertical columns (5) attached to the pontoon foundation and extending upwards and through the water surface, the method comprising the following steps:

the lifting vessel (1) is positioned around a platform comprising a deck and jacket by the use of tugs, and furthermore characterised by exact positioning of the lifting vessel (1) is carried out by operating hydraulically operated lifting frames (12, 12) of the lifting vessel (1) towards the lifting vessel (1) middle docking area, the lifting frames (12, 12) are locked in position for lifting off the platform deck, ballast water is let out of flushing tanks by opening a quick release trapdoors, whereupon the platform deck is swiftly lifted off the jacket; and the lifting vessel (1) with the platform deck is pulled away from the jacket and transported to its destination.

14. A method for positioning, lifting and handling a platform substructure, preferably a jacket, with the use of a ballastable lifting vessel (1) by establishing a connection between the lifting vessel (1) and the platform deck wherein the lifting vessel (1) comprising a lower U-shaped pontoon foundation (2*a*, 2*b*, 2*c*), and a number of vertical columns (5) attached to the pontoon foundation and extending upwards and through the water surface, containing the following steps:

the lifting vessel (1) is positioned around the jacket with the use of tugs, and furthermore, characterised by exact positioning of the lifting vessel (1), until a transversal pontoon (2*c*) bear against one side of the jacket, carried out by inclining hydraulically operated lifting flames (12, 12) towards the lifting vessel (1) middle docking area, the lifting vessel (1) is deballasted to correct draft and a tubular rotation beam (22) situated on top of the transversal pontoon (2*c*) gets a hold on lifting brackets (25) installed on the side of the jacket facing the transversal pontoon (2*c*), whereupon the lifting brackets (25) is locked to the rotation beam (22), ballast water is let out of flushing tanks by opening quick release trapdoors, whereupon the jacket is swiftly lifted off the seabed, the jacket is rotated about the tubular rotation beam (22) with the use of wires and winches and/or buoyancy modules, and the jacket is transported in an approximately horizontal position to its destination.

* * * * *

UNITED STATES PATENT AND TRADEMARK OFFICE

CERTIFICATE OF CORRECTION

PATENT NO. : 6,668,746 B1
DATED : December 30, 2003
INVENTOR(S) : John Schia et al.

It is certified that error appears in the above-identified patent and that said Letters Patent is hereby corrected as shown below:

Title page,
Insert item -- [30] Foreign Application Priority Data
Jun. 7, 1999 (NO) …. 19992759 --.

Signed and Sealed this

Twenty-seventh Day of April, 2004

JON W. DUDAS
*Acting Director of the United States Patent and Trademark Office*